US005484693A

United States Patent [19]

Valsecchi et al.

[11] Patent Number: 5,484,693

[45] Date of Patent: Jan. 16, 1996

[54] PHOTOGRAPHIC ELEMENTS COMPRISING ANTISTATIC FILM BASES

[75] Inventors: Alberto Valsecchi, Vado Ligure, Italy; Omar Farooq, Woodbury, Minn.

[73] Assignee: Minnesota Mining and Manufacturing Company, St. Paul, Minn.

[21] Appl. No.: 116,515

[22] Filed: Sep. 7, 1993

[30] Foreign Application Priority Data

Sep. 25, 1992 [IT] Italy ..... MI92A2208

[51] Int. Cl.[6] ..... G03C 1/85

[52] U.S. Cl. ..... 430/529

[58] Field of Search ..... 430/529

[56] References Cited

U.S. PATENT DOCUMENTS

| | | | |
|---|---|---|---|
| 4,266,016 | 5/1981 | Date et al. | 430/529 |
| 4,585,730 | 4/1986 | Cho | 430/527 |
| 5,098,822 | 3/1992 | Tachibana et al. | 430/529 |

FOREIGN PATENT DOCUMENTS

| | | |
|---|---|---|
| 188264B1 | 1/1986 | European Pat. Off. . |
| 0386529 | 9/1990 | European Pat. Off. . |
| 0486982 | 5/1992 | European Pat. Off. . |
| 1011809 | 12/1965 | United Kingdom . |

*Primary Examiner*—Charles L. Bowers, Jr.
*Assistant Examiner*—Christopher G. Young
*Attorney, Agent, or Firm*—Gary L. Griswold; Walter N. Kirn; Mark A. Litman

[57] ABSTRACT

Polymeric film bases at least one side of which is coated with an antistatic layer comprising the reaction product of (a) a water-soluble, electrically conductive polymer containing carboxylic groups and (b) a polyfunctional epoxide crosslinking agent, and photographic elements comprising said film bases, wherein said conductive polymer is a copolymer of a water soluble salt of styrene sulfonic acid and maleic acid having a weight average molecular weight of 100,000 to 350,000 and a water soluble salt of styrene sulfonic acid to maleic acid molar ratio of at least 2:1 up to 9:1.

7 Claims, No Drawings

PHOTOGRAPHIC ELEMENTS COMPRISING ANTISTATIC FILM BASES

FIELD OF THE INVENTION

The present invention relates to photographic film bases which are provided with antistatic layers, and to light-sensitive photographic elements comprising said film bases.

BACKGROUND OF THE ART

The use of polymeric film bases for carrying photographic layers is well known. In particular, photographic elements which require accurate physical characteristics use polyester film bases, such as poly(ethylene terephthalate) film bases. In fact, polyester film bases, when compared with commonly used cellulose ester film bases, are dimensionally more stable and more resistant to mechanical stresses under most conditions of use.

The formation of static electric charges on the film base is a serious problem in the production of photographic elements. While coating the light-sensitive photographic emulsion, electric charges accumulated on the base discharge, producing light which may be recorded as an image on the light-sensitive layer. Other drawbacks which result from the accumulation of electric charges on polymeric film bases are the adherence of dust and dirt and coating defects.

Additionally, photographic elements comprising light-sensitive layers coated onto polymeric film bases, when used in rolls or reels which are mechanically wound and unwound or in sheets which are conveyed at high speed, tend to accumulate static charges and record the light generated by the static discharges.

The static-related damages may occur not only before the photographic element has been manufactured, exposed and processed, but also after processing when the photographic element including the image is used to reproduce or enlarge the image. Accordingly, it is desired to provide permanent antistatic protection, that is an antistatic protection which retains its effectiveness even after photographic processing.

Several techniques have been suggested to protect photographic elements from the adverse effects of static charges.

Matting agents, hygroscopic materials or electroconductive polymers have been proposed to prevent static buildup, each acting with a different mechanism. However, matting agents cause haze, dust and dirt problems, hygroscopic materials cause sheets or films to stick together or with other surfaces, and electroconductive polymers are not permanent after photographic processing or are not transparent when coated with conventional binders.

U.S. Pat. No. 4,225,665 purports to disclose permanent antistatic layers for photographic elements. Said layers consist essentially of three components: (1) a water-soluble, electrically conductive polymer comprising carboxylic groups, (2) a hydrophobic polymeric binder containing carboxylic groups, and (3) a polyfunctional aziridine crosslinking agent. This compositon, however, does not give clear coatings and causes premature reactions among the components prior to coating. U.S. Pat. No. 4,701,403 suggests a costly system of coating the components as two separate coatings to avoid these premature reactions.

U.S. Pat. No. 4,585,730 discloses a photographic element comprising a film base, a silver halide emulsion on one side of the support, and an antistatic layer on the other side of said support, wherein the antistatic layer is coated with an auxiliary gelatin layer containing a conductive polymer, whereby the antistatic properties of the antistatic layer are conducted through said auxiliary layer. Reference is made to U.S. Pat. Nos. 4,225,665 and 4,701,403 as useful antistatic layers to be coated with the auxilary layer according to U.S. Pat. No. 4,585,730. Said two layer construction, however, often suffers from poor adhesion between the two layers during photographic processing.

An antistatic layer coated onto a polymeric film base has been described in EP 486,982. That antistatic layer comprises the reaction product of a copolymer of the sodium polystyrene sulfonate and maleic acid (having a weight average molecular weight of 16,700) with a polyfunctional epoxide crosslinking agent. This antistatic layer provides good adhesion of photographic gelatin layers coated over it even during photographic processing. A problem with these antistatic layers is that the rate of crosslinking is low, and both drying and curing at high temperature is needed to have a permanent antistatic layer which is water resistant. Drying and curing at high temperature, however, may result in cracking of the layer itself. It is preferred, therefore, to dry the layer at low temperature, but the rate of crosslinking is consequently lowered and the time for preparing the antistatic base in the manufacture of photographic films is lenghthened.

As increased speed in manufacturing, conveying and processing a film is important in the photographic industry, improvement in permanent antistatcity and wet adhesion of photographic layers are strongly desired.

SUMMARY OF THE INVENTION

In one embodiment, the invention is directed to a polymeric film base at least one side of which is coated with an antistatic layer comprising the reaction product of (a) a water-soluble, electrically conductive polymer containing carboxylic groups and (b) a polyfunctional epoxide crosslinking agent, wherein said conductive polymer is a copolymer of a water soluble salt of styrene sulfonic acid and maleic acid having a weight average molecular weight of 100,000 to 350,000 and a water soluble salt of styrene sulfonic acid to maleic acid molar ratio of at least 2:1 up to 9:1.

In a specific embodiment, the invention is directed to a photographic element comprising a polymeric film base, a silver halide emulsion layer on said film base, and an antistatic layer which comprises the reaction product of (a) a water-soluble, electrically conductive polymer containing carboxylic groups and (b) a polyfunctional epoxide crosslinking agent, wherein said conductive polymer is a copolymer of a water soluble salt of styrene sulfonic acid and maleic acid having a weight average molecular weight of 100,000 to 350,000 and a water soluble salt of styrene sulfonic acid to maleic acid molar ratio of at least 2:1 up to 9:1. This antistatic layer may be present as a backing layer on the side of the film base opposite the silver halide emulsion layer, as a subbing layer between the film base and the emulsion layer in a single or double side coated photographic element, and/or as a subbing layer between the film base and a different backing layer.

According to this invention, an antistatic layer is provided, coated onto a polymeric film base, which exhibits a high rate of crosslinking and good permanent antistatic properties.

DETAILED DESCRIPTION OF THE INVENTION

The present invention comprises an antistatic film base particularly useful for imaging media, especially silver halide photographic media. The film base comprises a polymeric substrate such as a polyester, and especially such as polyethyleneterephthalate. Other useful polymeric substrates include cellulose acetates, polyolefins, polycarbonates and the like. The film base has an antistatic layer adhered to one or both major surfaces of the base. A primer layer or subbing layer may be used between the base itself and the antistatic layer as is known in the art. Priming and subbing layers are, in fact, generally considered to be part of the base itself unless specifically excluded in the description (e.g., unsubbed polyester). Primer and subbing compositions are well known in the art and polymers of vinylidene chloride often comprise the primer composition of choice for photographic elements.

The antistatic layer of the present invention comprises the reaction product of (a) a water-soluble electrically conductive polymer having carboxylic groups and (b) a polyfunctional epoxide crosslinking agent, wherein said conductive polymer is a copolymer of a water soluble salt of styrene sulfonic acid and maleic acid having a weight average molecular weight of 100,000 to 350,000 and a water soluble salt of styrene sulfonic acid to maleic acid molar ratio of at least 2:1 up to 9:1. In the present invention, the molecular weight refers to the weight average molecular weight ($M_w$), as determined by GPC (Gel Permeation Chromatography) measurements.

The component (a) of the antistatic layer of the present invention is a water-soluble (e.g., soluble in water at room temperature for at least 5% in weight, preferably for at least 10%) electrically conductive hydrophilic copolymer having monomer units comprising:

(a') a water-soluble salt of a styrene sulfonic acid, such as an alkaline metal or ammonium salt, and (b') maleic acid, the molar ratio of (a') to (b') being at least 2:1 up to 9:1, and optionally (c') another ethylenically unsaturated monomer containing no free carboxylic groups.

More preferably, the component (a) is a copolymer of of sodium styrene sulfonate and maleic acid in a 2:1 to 4:1 mole ratio. The amount of units derived from electrically conductive monomers (a') serves to balance the requirements for antistatic protection with sufficient capability of the copolymer Lo become crosslinked through the carboxylic groups of units derived from monomers (b'). For example, monomer (a') may be styrene sulfonic acid, vinyltoluene sulfonic acid, α-methyl-styrene sulfonic acid, and 2-ethyl-styrene sulfonic acid, in the form of alkali metal salts thereof, preferably Na or K, or ammonium salts. Monomer (c'), if present, is to be chosen so as not negatively affect the electrical conductivity, water solubility and crosslinking capability of the polymers according to the present invention. Examples of monomers (c') are ethylenic monomers (such as isoprene, 1,3-butadiene, vinyl chloride, ethylene, propylene), styrene type monomers (such as styrene, vinyltoluene, α-methylstyrene, 2-ethyl-styrene, 1-vinylnaphthalene), 2-alkenoic acid esters (such methyl, ethyl, propyl, butyl, hexyl esters of acrylic, methacrylic, α-ethylacrylic, α-propylacrylic, 2-butenoic acids), acrylamide monomers (such as acrylamide, N-methylacrylamide, N,N-dimethylacrylamide, N-butyl-acrylamide, N-chloromethyl-acrylamide) and vinylacetate.

Examples of component (a) are poly(sodium styrene sulfonate-maleic acid), poly(potassium styrene sulfonate-maleic acid), poly(sodium styrene sulfonate-butyl acrylate-maleic acid), and the like. These components (a) may be purchased commercially or synthesized by copolymerizing the monomers as known in the art.

The component (b) of the antistatic layer of the present invention is a polyfunctional epoxide crosslinking agent, that is an organic compound, including a polymeric compound, containing at least two epoxide groups therein. Examples of component (b) are as follows: bis-(2,3-epoxypropyl) ether, vinyl cyclohexene dioxide, ethylene bis-glycidyl ether, bis-(2,3-epoxypropylethyl) ether, hydroquinone bis-glycidyl ether, resorcinol bisoglycidyl ether, diepoxybutane, diepoxyhexane, bis-glycidyl thioether, glycerol tris-glycidyl ether, bis-glycidyl malonic acid diethyl ester, bis-glycidyl sulfone, N,N-bis-glycidyl piperazine, tris-glycidyl phosphate, 2,4,6-tris-glycidyl cyanurate, oxalic acid bis-glycidyl ester, succinic acid bis-glycidyl ester, bis-(2,3-epoxypropyl)-methyl propyl ammonium p-toluene sulfonate, 1,5-pentane-bis(2,3-epoxypropyl diethyl ammonium methane sulfonate), 2-butyne-1,4-bis(2,3-epoxypropyl dimethyl ammonium perchlorate). These compounds are well known in the art as shown in U.S. Pat. Nos. 2,882,250, 3,047,394, 3,189,459, and in FR Patent No. 1,231,056. These compounds may be purchased commercially or synthesized as taught in the above patents.

Prior to being provided on the polymeric base, the antistatic polymer (a) and the crosslinking agent (b) are dissolved in an aqueous solution. The aqueous coating composition including the components (a) and (b) may be coated onto any suitable polymeric photographic base, but the preferred base is polyethyleneterephthalate film which has been subbed with a layer of resin, or layers of resin and gelatin. The antistatic coating is usually provided in coating weight based on the dry weight of from 0.01 $g/m^2$ to 1 $g/m^2$. Lower coating weights usually provide less adequate antistatic protection and higher coating weights usually give less transparent layers. The coating may be performed by conventional coating techniques, such as, for example, air knife coating, gravure coating, extrusion coating, curtain coating, and doctor roller coating. The antistatic layer of the present invention may also contain other addenda which do not influence the antistatic properties and the crosslinking capability of the combination of components (a) and (b), such as, for example, matting agents, plasticizers, lubricants, surfactants, dyes, and haze reducing agents. The antistatic layer of the present invention may be substantially binderless. The presence of additional binders is not required, but limited amounts (such as, for example, less than 10%, preferably less than 5% in weight based oil the weight of component (a)), of binders, such as gelatin, may be added to the coating composition comprising components (a) and (b) to improve coating quality or the adherence of the antistatic layer.

The reaction of (a) and (b) is effected by coating and drying of components (a) and (b) onto the polymeric substrate. Heating may be used to accelerate drying and/or the reaction of the components (curing) to form a permanent antistatic layer. Air temperatures of from 20° to 200° C. are useful for the drying-curing step, while the preferred range is 50° to 160° C. According to this invention, the rate of crosslinking provided by the conductive polymers having the molecular weight range described above has been found to be higher than that provided by corresponding conductive polymers having a lower molecular weight. It has been found, however, that limited amounts (such as, for example, less than 50%, preferably less than 30% in weight) of conductive polymers having a lower molecular weight may be added to the binderless antistatic layer of the present invention to obtain better coating quality.

The reaction product of (a) and (b) is a crosslinked product, having three-dimensional bonding within the layer. The crosslinking helps provide a permanent antistatic layer which is water-resistant and keeps low molecular weight materials within the component (a) from migrating out of the antistatic layer. Migration is reduced or eliminated into other photographic layers and/or into aqueous processing solutions by the tightening effect of the crosslinking on the internal structure of the antistatic layer.

The imaging elements useful in the present invention may be any of the well-known elements for imaging in the field of graphic arts, printing, medical and information systems. Silver halide, photopolymers, diazo, vesicular image-forming systems may be used, silver halide being preferred.

Typical imaging element constructions of the present invention comprise:

1. The film base with an antistatic layer on one surface and the photosensitive layer or layers, preferably photographic silver halide emulsion layer or layers, on the other surface of the film base. In this construction an auxiliary layer may or may not be present over the antistatic layer. Examples of auxiliary layers include backing gelatin protective layers and backing gelatin antihalation layers.
2. The film base with an antistatic layer on one surface and at least one photosensitive layer adhered to the same surface as the antistatic layer, over the antistatic layer.
3. The film base with antistatic layers on both surfaces of the polymeric base and at least one photosensitive layer on one or both sides of the film base, over said antistatic layers.

Examples of silver halide photographic elements applicable to this invention include black-and-white and color photographic elements.

The silver halide employed in this invention may be any of silver chloride, silver bromide, silver iodide, silver chlorobromide, silver chloroiodide, silver bromoiodide, silver chloroiodobromide, and the like.

The silver halide grains in the photographic emulsion may be regular grains having a regular crystal structure such as cube, octahedron, and tetradecahedron, or the spherical or irregular crystal structure, or those having crystal defects such as twin planes, or those having a tabular form, or combinations thereof.

As the binder or protective colloid for use in the photographic element, gelatin is advantageously used, but other hydrophilic colloids may be used such as gelatin substitutes, collodion, gum arabic, cellulose ester derivatives such as alkyl esters of carboxylated cellulose, hydroxy ethyl cellulose, carboxy methyl cellulose, synthetic resins, such as the amphoteric copolymers described in U.S. Pat. No. 2,949,442, polyvinyl alcohol, and others well known in the art.

The photographic elements utilizing the antistatic layer of this invention have radiation-sensitive silver halide emulsion layers, i.e. silver halide emulsions sensitive to the visible, ultraviolet or infrared light. The silver halide emulsions may be optically sensitized by any of the spectral sensitizers commonly used to produce the desired sensitometric characteristics.

Methods for making such elements, means for sensitizing them to radiation, use of additives such as chemical sensitizers, antifoggants and stabilizers, desensitizers, brightening agents, couplers, hardening agents, coating aids, plasticizers, lubricants, matting agents, high-boiling organic solvents, development accelerating compounds, antistatic agents, antistain agents, and the like are described for example, in Research Disclosure Vol. 176, No. 17643, December 1979, Sections I to XIV.

The following examples, which further illustrate the invention, report some experimental data obtained from processes and measurements which are of normal use in the art. Surface resistivity measurements were made using the following procedure: samples of each film were kept in a cell at 21° C. and 25% R.H. for 24 hours and the electrical resistivity was measured by means of a Hewlett-Packard High Resistance Meter model 4329A. Charge decay was measured at 21° C. and 25% RH using an ETS static decay meter model 406C: samples of each film were put in a Faraday cage and a positive charging voltage of 5 KV was applied to each sample; after that, the time needed to dissipate the applied charge to 10% of the initial charging voltage was measured. The following examples also report three adhesion values: the first is the dry adhesion value and refers to the adhesion of the silver halide emulsion layers and of the auxiliary gelatin layers to the antistatic base prior to the photographic processing; the second value is the wet adhesion value and refers to the adhesion of the above layers to the antistatic base during the photographic processing (developer and fixer); the third adhesion value is the dry adhesion value and refers to the adhesion of the above layers to the antistatic base after photographic processing. In particular, the dry adhesion was measured by tearing samples of the film, applying a 3M Scotch® brand 5959 Pressure Sensitive Tape along the tear line of the film and separating rapidly the tape from the film: the layer adhesion was evaluated according to a scholastic method giving a value of 2 when the whole layer was removed from the base and a value of 8 when no part thereof was removed from the base and intermediate values for intermediate situations. The wet adhesion was measured by drawing some lines with a pencil point to form an asterisk on the film just taken out from the processing bath and by rubbing on the lines with a finger. In this case the adhesion of the layers was evaluated according to a scholastic method by giving a value of 2 when the layers were totally removed from the base, a value of 8 when no portion thereof was removed and intermediate values for intermediate cases.

EXAMPLE 1

The following subbing compositions were prepared and coated onto a poly(ethylene terephthalate) film base (PET) resin-subbed on both sides with the terpolymer (vinylidene chloride-itaconic acid-methylmethacrylate) by the double roller coating technique and subsequent drying for 5 minutes at 60° C. (Coatings 1 to 4). The amounts of the components reported in the following Table 1 are expressed in grams.

TABLE 1

| | Subbing Compositions | | | |
|---|---|---|---|---|
| | 1 | 2 | 3 | 4 |
| Sodium styrenesulfonate-maleic acid (3:1 mole ratio) copolymer (Mw = 16,700) | 30.8 | — | 20.0 | 14.4 |
| Sodium styrenesuffonate-maleic acid (4:1 mole ratio) copolymer (Mw = 186,000) | — | 30.8 | 10.8 | 16.4 |
| Ethylenglycol-Diglycidylether (EDGE) 50% by weight | 4.4 | 4.4 | 4.4 | 4.4 |
| Surfactant FC-128 30% by weight | 0.2 | 0.2 | 0.2 | 0.2 |
| Water | 1000 | 1000 | 1000 | 1000 |

FC-128 is a fluorosurfactant of 3M Co.

The surface electrical resistivity was measured at 21° C. and 25% RH for unprocessed samples and for samples processed in 3M RDC5 developer after different days of natural ageing.

The following Table 2 reports the values of surface electrical resistivity for the various coatings.

TABLE 2

| Surface Electrical Resistivity Ohm/sq 21° C. 25% R.H. | Coatings 1 | 2 | 3 | 4 |
|---|---|---|---|---|
| Unprocessed samples | $6.3 \times 10^9$ | $1.6 \times 10^{10}$ | $2 \times 10^{10}$ | $1.7 \times 10^{10}$ |
| After processing in 3M RDC5 Developer: | | | | |
| 1 day shelf ageing | $>1 \times 10^{16}$ | $>1 \times 10^{16}$ | $>1 \times 10^{16}$ | $>1 \times 10^{16}$ |
| 2 days shelf ageing | $>1 \times 10^{16}$ | $5 \times 10^{10}$ | $>1 \times 10^{16}$ | $>1 \times 10^{16}$ |
| 4 days shelf ageing | $>1 \times 10^{16}$ | $4 \times 10^{10}$ | $3 \times 10^{11}$ | $2 \times 10^{12}$ |
| 7 days shelf ageing | $1 \times 10^{15}$ | $8 \times 10^{10}$ | $7 \times 10^{11}$ | $4 \times 10^{12}$ |
| 14 days shelf ageing | $2 \times 10^{13}$ | $6 \times 10^{10}$ | $4 \times 10^{11}$ | $3 \times 10^{12}$ |

From the results in Table 2 it call be seen how the samples including the high molecular weight conductive polymer reaches good postprocessing antistatic properties after shorter shelf ageing times than the sample including the low molecular weight conductive polymer.

EXAMPLE 2

The following subbing compositions were prepared and coated at a coating speed of 10 meters/minute onto a poly(ethylene terephthalate) film base (PET) resin-subbed on both sides with the terpolymer (vinylidene chloride-itaconic acid-methylmethacrylate) by the rotogravure coating technique and subsequent drying for 30 seconds at 60° C. (Coatings 1 to 14). The amounts of the components reported in the following Table 3 are expressed in grams.

TABLE 3

| | SS/MA copolymer | | | FC127 | | |
|---|---|---|---|---|---|---|
| Coating | SS:MA | Mw | Amount | EDGE | surfact. | Water |
| 1 | 3:1 | 16,700 | 70 | 10 | 0.01 | 920 |
| 2 | 1:1 | 20,000 | 70 | 20 | 0.01 | 910 |
| 3 | 3:1 | 25,700 | 70 | 10 | 0.01 | 920 |
| 4 | 4:1 | 61,600 | 70 | 8 | 0.01 | 922 |
| 5 | 2:1 | 125,000 | 70 | 13.2 | 0.01 | 917 |
| 6 | 3:1 | 150,000 | 70 | 10 | 0.01 | 920 |
| 7 | 4:1 | 150,000 | 70 | 8 | 0.01 | 922 |
| 8 | 4:1 | 186,000 | 70 | 8 | 0.01 | 922 |
| 9 | 4:1 | 200,000 | 70 | 8 | 0.01 | 922 |
| 10 | 1:1 | 200,000 | 70 | 20 | 0.01 | 910 |
| 11 | 4:1 | 400,000 | 70 | 10 | 0.01 | 920 |
| 12 | 3:1 | 600,000 | 70 | 10 | 0.01 | 920 |
| 13 | 2:1 | 600,000 | 70 | 13.2 | 0.01 | 917 |
| 14 | 1:1 | 800,000 | 70 | 20 | 0.01 | 910 |

SS/MA is the copolymer of sodium styrene sulfonate and maleic acid
SS:MA is the molar ratio of sodium styrene sulfonate to maleic acid
Mw is the weight average molecular weight
EDGE is ethyleneglycol-diglycidylether
FC-127 is a fluorosurfactant of 3M Co.

Samples of coating 1 were stored for 4 days at 60° C. (heat soaking). Other samples of coating 1 and coatings 2 to 14 were stored for 7 days at room temperature (shelf ageing). Each sample was overcoated with a light-sensitive emulsion comprising a gelatino-silver chlorobromide emulsion having 96% mole Cl and 4% mole Br and having been brought to its optimum sensitivity with gold and sulfur. Conventional wetting agents, antifoggants, hardeners and coating aids were also added. The emulsion showed cubic grains with an average grain size in the range of 0.1–0.3 micrometers. A hardened gelatin antiabrasion layer containing matting agent, and surfactant was coated thereon. The two gelatin layers were coated at 2.7 g/m$^2$ of silver and 4.5 g/m$^2$ of gelatin. The total thickness of the gelatin layers was in the range of 4–5 micrometers.

The following Table 4 reports the values of charge decay of coatings 1 to 14 (A), coatings 1 to 14 with the emulsion layer before processing in 3M RDC5 Developer (B) and coatings 1 to 14 with the emulsion layer after processing (C), and adhesion of coatings 1 to 14 with the emulsion layer before processing (D), during processing (E) and after processing (F).

TABLE 4

| | Charge Decay (sec) | | | Adhesion | | |
|---|---|---|---|---|---|---|
| Coatings | A | B | C | D | E | F |
| 1 (heat soaked) | 0.01 | 0.16 | 0.29 | 10 | 10 | 10 |
| 1 (shelf aged) | 0.01 | 9.40 | >60 | 10 | 7 | 10 |
| 2 (shelf aged) | 0.10 | 3.3 | 9.2 | 10 | 8 | 10 |
| 3 (shelf aged) | 0.03 | 12 | >60 | 10 | 6 | 10 |
| 4 (shell aged) | 0.03 | — | >60 | 10 | 8 | 10 |
| 5 (shelf aged) | 0.02 | 0.04 | 0.43 | 10 | 10 | 10 |
| 6 (shelf aged) | 0.02 | 0.03 | 0.36 | 10 | 10 | 10 |
| 7 (shelf aged) | 0.01 | 0.01 | 0.48 | 10 | 10 | 10 |
| 8 (shelf aged) | 0.01 | 0.12 | 0.16 | 10 | 10 | 10 |
| 9 (shelf aged) | 0.01 | 0.20 | 0.56 | 10 | 10 | 10 |
| 10 (shelf aged) | 0.43 | — | — | — | — | — |
| 11 (shelf aged) | 0.02 | 3.50 | — | 10 | 10 | 10 |
| 12 (shelf aged) | 0.04 | 2.03 | >60 | 10 | 10 | 10 |
| 13 (shelf aged) | 0.50 | 14 | — | 10 | 10 | 10 |
| 14 (shelf aged) | 0.62 | >60 | — | 10 | 10 | 10 |

To explain missing data from the table, it must be considered that when one value of charge decay was higher than the acceptable value (i.e., >0.1 sec. for A, >1 sec. for B or >3 sec for C) the other values were often not measured.

From the results in Table 4 it can be seen that coatings 5 to 9 comprising conductive polymers having molecular weights and SS:MA molar ratios according to the present invention provide charge decays and wet adhesion values on shelf ageing which are similar to those obtained with coating 1 after heat soaking.

We claim:

1. A photographic film comprising an antistatic film base comprising a polymeric substrate having on at least one surface of said substrate an antistatic layer comprising the reaction product of (a) a water-soluble electrically conductive polymer having carboxylic groups and (b) an organic crosslinking agent comprising at least two epoxide groups, wherein said conductive polymer is a copolymer of a water-soluble salt of styrene sulfonic acid and maleic acid, said conductive polymer having a weight average molecular weight of 100,000 to 350,000, and said conductive polymer has a molar ratio of water-soluble salt of styrene sulfonic acid to maleic acid of at least 2:1 up to 9:1, said film base having a silver halide emulsion layer adhered to at least one side of said film base.

2. The photographic film of claim 1 wherein said emulsion layer is on the same side of said film base as said antistatic layer.

3. The photographic film of claim 1 wherein said emulsion layer is on the opposite side of said film base as said antistatic layer.

4. The photographic film of claim 3 wherein an auxiliary gelatin layer is adhered to said antistatic layer.

5. The photographic film of claim 1 wherein the carboxylic group containing polymer is a copolymer of sodium styrene sulfonic acid and maleic acid.

6. The photographic element of claim 1 wherein the antistatic layer has a coating weight of 0.01 $g/m^2$ to 1 $g/m^2$.

7. The photographic film of claim 1 wherein the antistatic layer is a subbing layer under at least one silver halide emulsion layer coated on one or both sides of the film base.

* * * * *